US010181301B2

(12) United States Patent
Hong et al.

(10) Patent No.: US 10,181,301 B2
(45) Date of Patent: Jan. 15, 2019

(54) LIQUID CRYSTAL DISPLAY AND DEMULTIPLEXER THEREOF

(71) Applicant: WUHAN CHINA STAR OPTOELECTRONICS TECHNOLOGY CO., LTD., Wuhan (CN)

(72) Inventors: Guanghui Hong, Wuhan (CN); Qiang Gong, Wuhan (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 183 days.

(21) Appl. No.: 15/126,409

(22) PCT Filed: Jul. 19, 2016

(86) PCT No.: PCT/CN2016/090383

§ 371 (c)(1),
(2) Date: Sep. 15, 2016

(87) PCT Pub. No.: WO2017/206287

PCT Pub. Date: Dec. 7, 2017

(65) Prior Publication Data

US 2018/0197491 A1 Jul. 12, 2018

(30) Foreign Application Priority Data

May 30, 2016 (CN) ..... 2016 1 0370373

(51) Int. Cl.
*G09G 3/36* (2006.01)

(52) U.S. Cl.
CPC ..... *G09G 3/3607* (2013.01); *G09G 3/36* (2013.01); *G09G 3/3659* (2013.01); *G09G 3/3674* (2013.01); *G09G 2300/0814* (2013.01); *G09G 2310/0291* (2013.01)

(58) Field of Classification Search
CPC ..... G09G 3/3607; G09G 3/3659; G09G 2300/0814; G09G 3/36
See application file for complete search history.

(56) References Cited

U.S. PATENT DOCUMENTS

| | | | | |
|---|---|---|---|---|
| 5,850,216 | A | 12/1998 | Kwon | |
| 2008/0165112 | A1* | 7/2008 | Su | G09G 3/3677 345/100 |
| 2018/0061346 | A1 | 3/2018 | Zhao et al. | |

FOREIGN PATENT DOCUMENTS

| | | | |
|---|---|---|---|
| CN | 102881248 | A | 1/2013 |
| CN | 105355179 | A | 2/2016 |
| CN | 105448267 | A | 3/2016 |
| JP | H11282426 | A | 10/1999 |
| KR | 100214484 | B1 | 8/1999 |

* cited by examiner

*Primary Examiner* — Dmitriy Bolotin
(74) *Attorney, Agent, or Firm* — JMB Davis Ben-David

(57) ABSTRACT

A liquid crystal display comprises a demultiplexer (Demux). The demultiplexer for the display comprises an integrated circuit unit and a logic unit electrically connected to the integrated circuit unit. The integrated circuit unit outputs three pulse signals including a first pulse signal, a second pulse signal, and a third pulse signal. The logic unit transforms the three pulse signals having different high and low voltage levels into at least four control signals.

9 Claims, 5 Drawing Sheets

LIQUID CRYSTAL DISPLAY AND DEMULTIPLEXER THEREOF

CROSS-REFERENCE TO RELATED APPLICATIONS

This is the U.S. National Stage of International Patent Application No. PCT/CN2016/090383, filed Jul. 19, 2016, which in turn claims the benefit of China Patent Application No. 201610370373.7, filed May 30, 2016.

TECHNICAL FIELD OF THE DISCLOSURE

The present invention relates to a liquid crystal display technology, and more particularly, to a demultiplexer and a liquid crystal display having the demultiplexer.

BACKGROUND OF THE DISCLOSURE

Nowadays, liquid crystal displays have widely used in electronic display products such as televisions, computer screens, notebooks, mobile phones, and etc.

In the array manufacture of the liquid crystal display, there has a demultiplexer (Demux) circuit that is utilized to reduce the amount of output pins of an integrated circuit (IC). In common circumstances, those Demux circuits frequently used are divided into two types. The first type is a Demux circuit carrying out control by use of N-type TFTs (Thin Film Transistors) and it requires four timing control signals (CKR, CKG, CKB, CKW). The second type is a Demux circuit using P-type TFTs for the gate control and it requires eight timing control signals (CKR, CKG, CKB, CKW, XCKR, XCKG, XCKB, XCKW). Both of the two types of Demux circuits can carry out multiple-path output (for example, 1 to 4) for the IC signals, thereby reducing the amount of output pins of the integrated circuit to a great degree. However, in common circumstances, all the timing control signals of the Demux circuit are usually outputted respectively by individual pins of the integrated circuit. For a high-resolution thin-film-transistor liquid crystal display, this is a great challenge for the amount of output pins of the integrated circuit and the product cost may be increased as well.

Therefore, it is necessary to provide a Demux circuit in order to solve the problems in the existing skills.

SUMMARY OF THE DISCLOSURE

The present invention provides a liquid crystal display and a demultiplexer (Demux) for a display in order to further reduce the cost of the liquid crystal display.

The present invention provides a demultiplexer (Demux) for a display, which comprises: an integrated circuit unit configured to output three pulse signals including a first pulse signal, a second pulse signal, and a third pulse signal; and a logic unit electrically connected to the integrated circuit unit and configured to transform the three pulse signals having different high and low voltage levels into at least four control signals; wherein the logic unit comprises four 3-input NAND gates and four buffers, the four buffers and the four 3-input NAND gates are electrically connected to each other in a one-to-one correspondence; the four 3-input NAND gates respectively are a first 3-input NAND gate, a second 3-input NAND gate, a third 3-input NAND gate, and a fourth 3-input NAND gate; the four buffers respectively are a first buffer, a second buffer, a third buffer, and a fourth buffer; wherein a first input terminal of the first 3-input NAND gate is electrically connected to a second input terminal of the second 3-input NAND gate and the second input terminal of the third 3-input NAND gate; the second input terminal of the first 3-input NAND gate is electrically connected to a third input terminal of the second 3-input NAND gate and the second input terminal of the fourth 3-input NAND gate; the third input terminal of the first 3-input NAND gate is electrically connected to the third input terminal of the third 3-input NAND gate and the third input terminal of the fourth 3-input NAND gate; an output terminal of the first 3-input NAND gate is electrically connected to the first input terminal of the second 3-input NAND gate, the first input terminal of the third 3-input NAND gate, the first input terminal of the fourth 3-input NAND gate, and an input terminal of the first buffer; the output terminal of the second 3-input NAND gate is electrically connected to the input terminal of the second buffer; the output terminal of the third 3-input NAND gate is electrically connected to the input terminal of the third buffer; the output terminal of the fourth 3-input NAND gate is electrically connected to the input terminal of the fourth buffer; the first pulse signal, the second pulse signal, and the third pulse signal are respectively inputted to the first input terminal, the second input terminal, and the third input terminal of the first 3-input NAND gate; wherein each buffer comprises a first inverter set and the first inverter set comprises three inverters connected in series; wherein when the first input terminal of the 3-input NAND gate is inputted with an A signal, the second input terminal of the 3-input NAND gate is inputted with a B signal, and the third input terminal of the 3-input NAND gate is inputted with a C signal, then the output terminal of the 3-input NAND gate outputs a D signal, where $D=\overline{A+B+C}$; when the input terminal of the inverter is inputted with an E signal, then the output terminal of the inverter outputs a F signal, where $F=\overline{E}$; wherein the logic unit transforms the three pulse signals having different high and low voltage levels into four control signals; the four control signals respectively are a first control signal, a second control signal, a third control signal, and a fourth control signal.

A demultiplexer (Demux) for a display, comprising: an integrated circuit unit configured to output three pulse signals including a first pulse signal, a second pulse signal, and a third pulse signal; and a logic unit electrically connected to the integrated circuit unit and configured to transform the three pulse signals having different high and low voltage levels into at least four control signals. In the demultiplexer of the present invention, the logic unit is added and is configured to transform the three pulse signals, outputted by the integrated circuit unit, having different high and low voltage levels into at least four control signals. In this way, the present invention can avoid outputting each control signal by using each corresponding pin of the integrated circuit unit, thereby reducing the amount of output pins of the integrated circuit unit as well as reducing the cost.

In the demultiplexer for the display in accordance with the present invention, the logic unit comprises NAND gate components and buffer components electrically connected to the NAND gate components; the integrated circuit unit provides three pulse signals to the NAND gate components.

In the demultiplexer for the display in accordance with the present invention, the NAND gate components comprise four 3-input NAND gates combined and connected to each other, the buffer components comprises four buffers, and the four buffers and the four 3-input NAND gates are electrically connected to each other in a one-to-one correspondence; the four 3-input NAND gates respectively are a first 3-input NAND gate, a second 3-input NAND gate, a third 3-input NAND gate, and a fourth 3-input NAND gate; the four buffers respectively are a first buffer, a second buffer, a third buffer, and a fourth buffer.

In the demultiplexer for the display in accordance with the present invention, a first input terminal of the first 3-input NAND gate is electrically connected to a second input terminal of the second 3-input NAND gate and the second input terminal of the third 3-inputs NAND gate; the second input terminal of the first 3-input NAND gate is electrically connected to a third input terminal of the second 3-input NAND gate and the second input terminal of the fourth 3-input NAND gate; the third input terminal of the first 3-input NAND gate is electrically connected to the third input terminal of the third 3-input NAND gate and the third input terminal of the fourth 3-input NAND gate; an output terminal of the first 3-input NAND gate is electrically connected to the first input terminal of the second 3-input NAND gate, the first input terminal of the third 3-input NAND gate, the first input terminal of the fourth 3-input NAND gate, and an input terminal of the first buffer; the output terminal of the second 3-input NAND gate is electrically connected to the input terminal of the second buffer; the output terminal of the third 3-input NAND gate is electrically connected to the input terminal of the third buffer; the output terminal of the fourth 3-input NAND gate is electrically connected to the input terminal of the fourth buffer; the first pulse signal, the second pulse signal, and the third pulse signal are respectively inputted to the first input terminal, the second input terminal, and the third input terminal of the first 3-input NAND gate.

In the demultiplexer for the display in accordance with the present invention, each buffer comprises a first inverter set and the first inverter set comprises three inverters connected in series.

In the demultiplexer for the display in accordance with the present invention, each buffer further comprises a second inverter set, the second inverter set comprises two inverters connected in series, and the second inverter set and the first inverter set are connected in parallel.

In the demultiplexer for the display in accordance with the present invention, when the first input terminal of the 3-input NAND gate is inputted with an A signal, the second input terminal of the 3-input NAND gate is inputted with a B signal, and the third input terminal of the 3-input NAND gate is inputted with a C signal, then the output terminal of the 3-input NAND gate outputs a D signal, where $D=\overline{A+B+C}$; when the input terminal of the inverter is inputted with an E signal, then the output terminal of the inverter outputs a F signal, where $F=\overline{E}$.

In the demultiplexer for the display in accordance with the present invention, the logic unit transforms the three pulse signals having different high and low voltage levels into four control signals; the four control signals respectively are a first control signal, a second control signal, a third control signal, and a fourth control signal.

In the demultiplexer for the display in accordance with the present invention, the logic unit transforms the three pulse signals having different high and low voltage levels into eight control signals; the eight control signals respectively are a first control signal, a second control signal, a third control signal, a fourth control signal, a fifth control signal, a sixth control signal, a seventh control signal, and an eighth control signal.

The present invention further provides a liquid crystal display, which comprises the demultiplexer as described above.

In the demultiplexer of the present invention, the logic unit is added and is configured to transform the three pulse signals, outputted by the integrated circuit unit, having different high and low voltage levels into at least four control signals. In this way, the present invention can avoid outputting each control signal by using each corresponding pin of the integrated circuit unit, thereby reducing the amount of output pins of the integrated circuit unit as well as reducing the cost.

BRIEF DESCRIPTION OF THE DRAWINGS

To illustrate the technical solutions in the embodiments of the present invention or in the existing skills more clearly, the following briefly introduces the accompanying drawings required for describing the embodiments of the present invention. The accompanying drawings in the following description show some embodiments of the present invention, and a person of ordinary skill in the art may still derive other drawings from these accompanying drawings without creative efforts.

DETAILED DESCRIPTION OF THE DISCLOSURE

Please refer to the appending drawings, the same components are indicated by the same reference numbers. The following descriptions are based on the exemplary embodiment of the present invention and should not be taken to limit the present invention and other embodiments not described herein.

Figure 1:
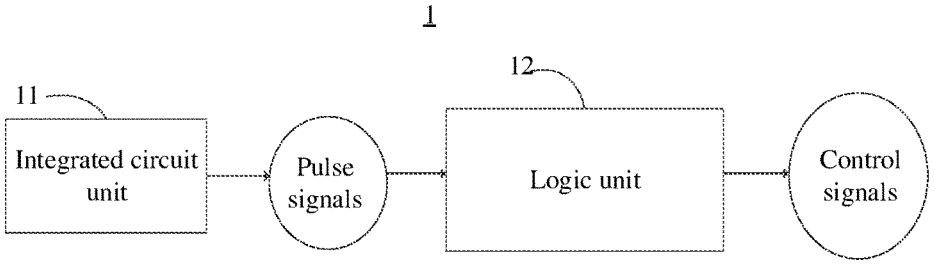
FIG. 1 is a schematic structural diagram showing a demultiplexer for a display in accordance with the present invention.

As shown in FIG. 1, the present invention provides a demultiplexer (Demux) circuit 1 for a display, which comprises an integrated circuit unit 11 and a logic unit 12 electrically connected to the integrated circuit unit 11. The integrated circuit unit 11 is configured to output three pulse signals including a first pulse signal V1, a second pulse signal V2, and a third pulse signal V3. In common circumstances, the three pulse signals are directly outputted respectively via three pins of the integrated circuit unit 11.

The logic unit 12 is configured to transform the three pulse signals having different high and low voltage levels into at least four control signals. In the demultiplexer of the present invention, the logic unit is added and is configured to transform the three pulse signals, outputted by the integrated circuit unit, having different high and low voltage levels into at least four control signals. In this way, the present invention can avoid outputting each control signal by using each corresponding pin of the integrated circuit unit, thereby reducing the amount of output pins of the integrated circuit unit as well as reducing the cost.

Specifically, the logic unit comprises NAND gate components 121 and buffer components 122 electrically connected to the NAND gate components 121. The NAND gate components 121 comprise four 3-input NAND gates. The four 3-input NAND gates respectively are a first 3-input NAND gate, a second 3-input NAND gate, a third 3-input NAND gate, and a fourth 3-input NAND gate. The buffer components 122 comprises four buffers. The four buffers respectively are a first buffer, a second buffer, a third buffer, and a fourth buffer. The four buffers and the four 3-input NAND gates are electrically connected to each other in a one-to-one correspondence.

Specifically, a first input terminal of the first 3-input NAND gate is electrically connected to a second input terminal of the second 3-input NAND gate and the second input terminal of the third 3-input NAND gate. The second input terminal of the first 3-input NAND gate is electrically connected to a third input terminal of the second 3-input NAND gate and the second input terminal of the fourth 3-input NAND gate. The third input terminal of the first 3-input NAND gate is electrically connected to the third input terminal of the third 3-input NAND gate and the third input terminal of the fourth 3-input NAND gate.

An output terminal of the first 3-input NAND gate is electrically connected to the first input terminal of the second 3-input NAND gate, the first input terminal of the third 3-input NAND gate, the first input terminal of the fourth 3-input NAND gate, and an input terminal of the first buffer. The output terminal of the second 3-input NAND gate is electrically connected to the input terminal of the second buffer. The output terminal of the third 3-input NAND gate is electrically connected to the input terminal of the third buffer. The output terminal of the fourth 3-input NAND gate is electrically connected to the input terminal of the fourth buffer. The first pulse signal, the second pulse signal, and the third pulse signal are respectively inputted to the first input terminal, the second input terminal, and the third input terminal of the first 3-input NAND gate.

Figure 2:
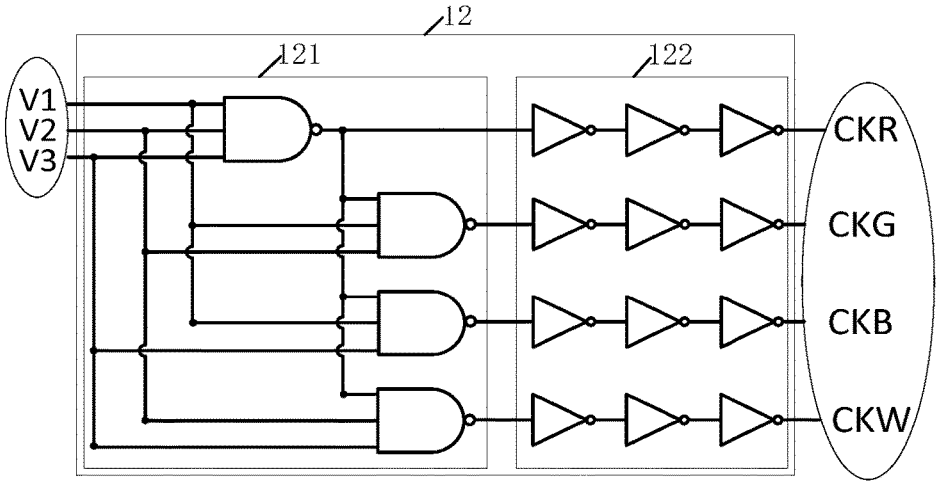
FIG. 2 is a schematic structural diagram showing a demultiplexer for a display in accordance with embodiment I of the present invention.

As shown in FIG. 2, in the present preferred embodiment I, each buffer comprises a first inverter set and the first inverter set comprises three inverters connected in series. The logic unit transforms the three pulse signals having different high and low voltage levels into four control signals that are then outputted by each output terminal of the buffers. The four control signals respectively are a first control signal CKR, a second control signal CKG, a third control signal CKB, and a fourth control signal CKRW.

The function of the logic unit pertains to transmitting and processing discrete signals. Binary principle is applied to carry out logic operation of digital signals. More specifically, the 3-input NAND gate of the logic unit is a combination of AND gate and NOT gate. The AND operation is performed first, and then the NOT operation. When the first input terminal of the 3-input NAND gate is inputted with an A signal, the second input terminal of the 3-input NAND gate is inputted with a B signal, and the third input terminal of the 3-input NAND gate is inputted with a C signal, then the output terminal of the 3-input NAND gate outputs a D signal, where $D=\overline{A+B+C}$. The truth table is illustrated in Table 1 below.

TABLE 1

| Input Terminal | | | Output terminal |
|---|---|---|---|
| A | B | C | D |
| 0 | 0 | 0 | 1 |
| 0 | 0 | 1 | 0 |
| 0 | 1 | 0 | 0 |
| 0 | 1 | 1 | 0 |
| 1 | 0 | 0 | 0 |
| 1 | 0 | 1 | 0 |
| 1 | 1 | 0 | 0 |
| 1 | 1 | 1 | 0 |

The inverter of the logic unit can invert the phase of an input signal by 180 degrees. When the input terminal of the inverter is inputted with an E signal, then the output terminal of the inverter outputs a F signal, where $F=\overline{E}$. The truth table is illustrated in Table 2 below.

TABLE 2

| Input terminal E | Output terminal F |
|---|---|
| 1 | 0 |
| 0 | 1 |

Figure 3:
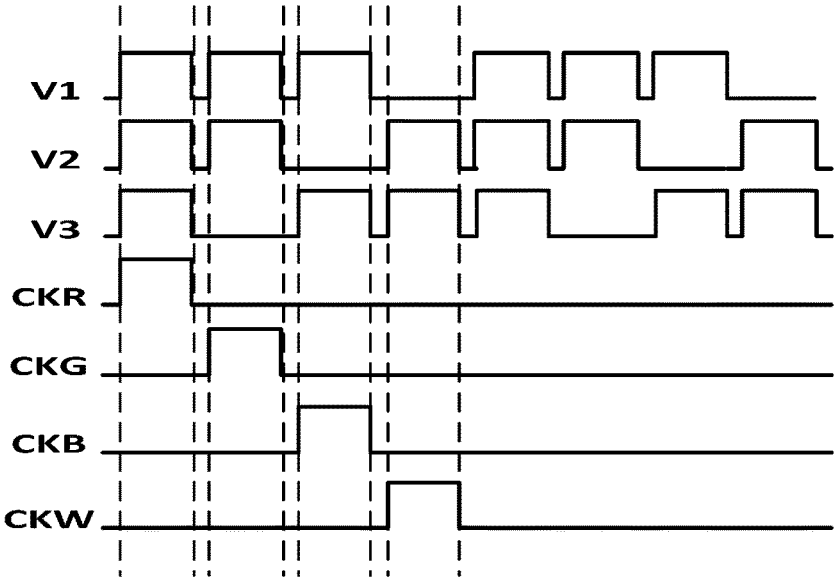
FIG. 3 is a timing chart of a pulse signal and a control signal of a demultiplexer for a display in accordance with embodiment I of the present invention.

Therefore, with reference to FIG. 2 together with FIG. 3, in the demultiplexer, the principles of generating the four control signals via the logic unit are described below.

When the pulse signals V1, V2, and V3 are simultaneously at the high voltage level, CKR output is high voltage level and CKG, CKB, and CKW outputs are low voltage levels through the operation of the logic unit. The logic unit may take the high-voltage-level CKR signal as a control signal and output the same.

When the pulse signal V1 is at high voltage level, the pulse signal V2 is at high voltage level, and the pulse signal V3 is at low voltage level, CKG output is high voltage level and CKR, CKB, and CKW outputs are low voltage levels. The logic unit may take the high-voltage-level CKG signal as a control signal and output the same.

When the pulse signal V1 is at high voltage level, the pulse signal V2 is at low voltage level, and the pulse signal V3 is at high voltage level, CKB output is high voltage level and CKR, CKG, and CKW outputs are low voltage levels. The logic unit may take the high-voltage-level CKB signal as a control signal and output the same.

When the pulse signal V1 is at low voltage level, the pulse signal V2 is at high voltage level, and the pulse signal V3 is at high voltage level, CKW output is high voltage level and CKR, CKG, and CKB outputs are low voltage levels. The logic unit may take the high-voltage-level CKW signal as a control signal and output the same.

When the pulse signals V1, V2, and V3 are simultaneously at the low voltage level, CKR, CKG, CKB, and CKW outputs are low voltage levels. The logic unit may not output any control signal.

In this way, the three pulse signals outputted by the integrated circuit unit can be transformed, by use of operation of the logic unit, into four control signals (CKR, CKG, CKB, CKW), which are outputted respectively via the output terminals of the four buffers of the logic unit, thereby saving the amount of pins of the integrated circuit unit to a certain degree as well as reducing the cost.

Figure 4:
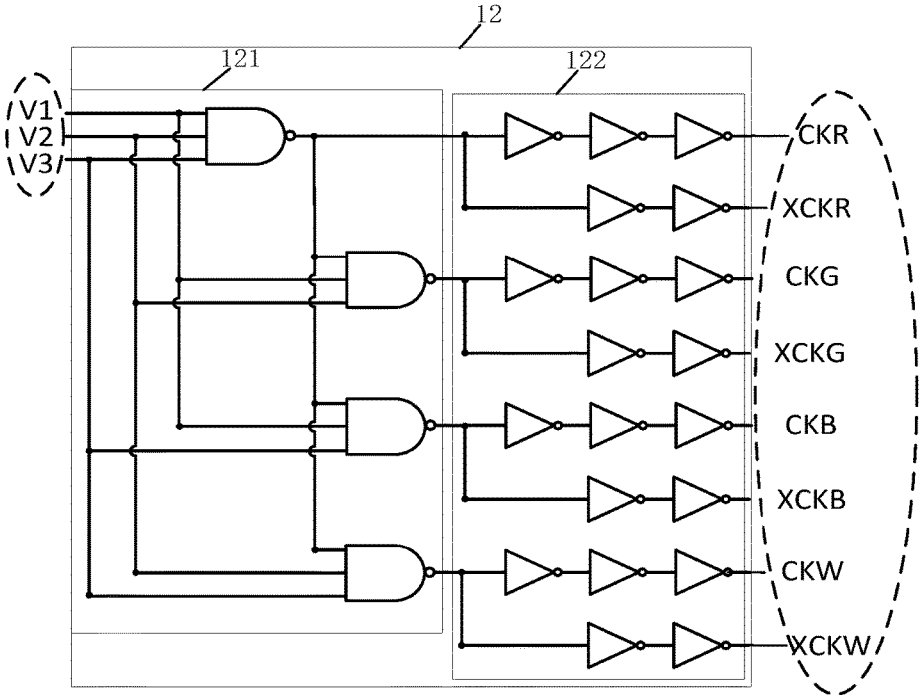
FIG. 4 is a schematic structural diagram showing a demultiplexer for a display in accordance with embodiment II of the present invention.

As shown in FIG. 4, in the present preferred embodiment II, each buffer comprises a first inverter set and a second inverter set connected in parallel to the first inverter set. The first inverter set comprises three inverters connected in series. The second inverter set comprises two inverters connected in series. Therefore, each buffer has two output terminals. The logic unit transforms the three pulse signals having different high and low voltage levels into eight control signals that are then outputted by the output terminals of the buffers. The four control signals respectively are a first control signal CKR, a second control signal CKG, a third control signal CKB, a fourth control signal CKW, a fifth control signal XCKR, a sixth control signal XCKG, a seventh control signal XCKB, and an eighth control signal XCKW.

Figure 5:
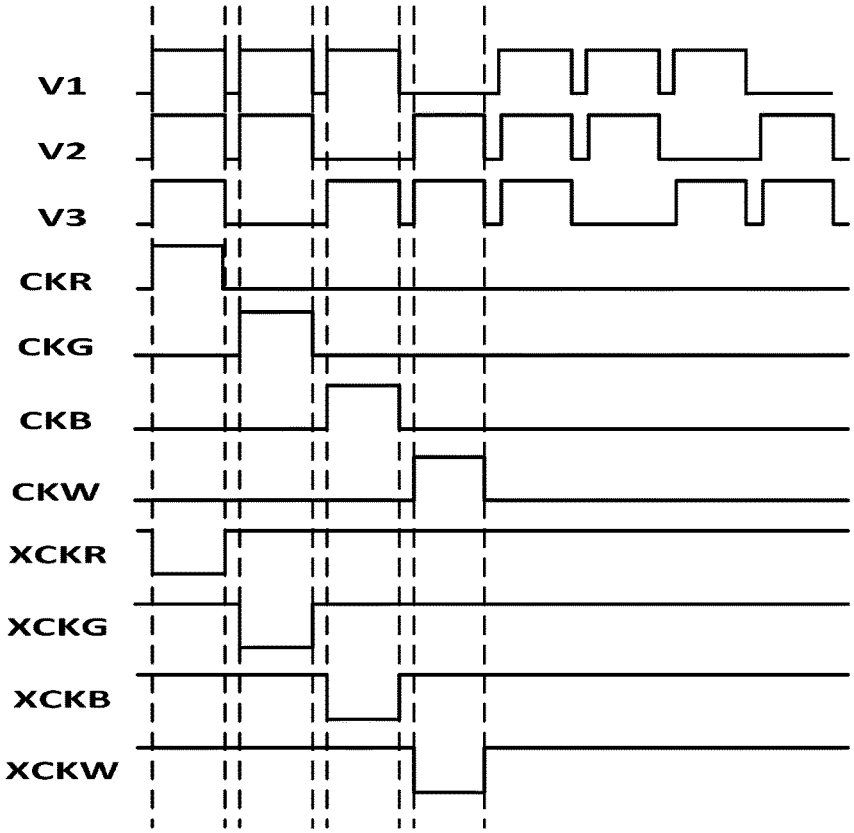
FIG. 5 is a timing chart of a pulse signal and a control signal of a demultiplexer for a display in accordance with embodiment II of the present invention.

The operation principle is similar to the embodiment I of the present invention. Therefore, with reference to FIG. 4 together with FIG. 5, in the demultiplexer, the principles of generating the eight control signals via the logic unit are described below.

When the pulse signals V1, V2, and V3 are simultaneously at the high voltage level, CKR output is high voltage level, XCKR output is low voltage level, CKG output is low voltage level, XCKG output is high voltage level, CKB output is low voltage level, XCKB output is high voltage level, CKW output is low voltage level, and XCKW output is high voltage level through the operation of the logic unit. The logic unit may take the high-voltage-level CKR signal and the low-voltage-level XCKR signal as control signals and output the same.

When the pulse signal V1 is at high voltage level, the pulse signal V2 is at high voltage level, and the pulse signal V3 is at low voltage level, CKG output is high voltage level, XCKG output is low voltage level, CKR output is low voltage level, XCKR output is high voltage level, CKB output is low voltage level, XCKB output is high voltage level, CKW output is low voltage level, and XCKW output is high voltage level. The logic unit may take the high-voltage-level CKG signal and the low-voltage-level XCKG signal as control signals and output the same.

When the pulse signal V1 is at high voltage level, the pulse signal V2 is at low voltage level, and the pulse signal V3 is at high voltage level, CKB output is high voltage level, XCKB output is low voltage level, CKR output is low voltage level, XCKR output is high voltage level, CKG output is low voltage level, XCKG output is high voltage level, CKW output is low voltage level, and XCKW output is high voltage level. The logic unit may take the high-voltage-level CKB signal and the low-voltage-level XCKB signal as control signals and output the same.

When the pulse signal V1 is at low voltage level, the pulse signal V2 is at high voltage level, and the pulse signal V3 is at high voltage level, CKW output is high voltage level, XCKW output is low voltage level, CKR output is low voltage level, XCKR output is high voltage level, CKG output is low voltage level, XCKG output is high voltage level, CKB output is low voltage level, and XCKB output is high voltage level. The logic unit may take the high-voltage-level CKW signal and the low-voltage-level XCKW signal as control signals and output the same.

When the pulse signals V1, V2, and V3 are simultaneously at the low voltage level, CKR output is low voltage level, XCKR output is high voltage level, CKG output is low voltage level, XCKG output is high voltage level, CKB output is low voltage level, XCKB output is high voltage level, CKW output is low voltage level, and XCKW output is high voltage level. The logic unit may not output any control signal.

In this way, the three pulse signals outputted by the integrated circuit unit can be transformed, by use of operation of the logic unit, into eight control signals (CKR, CKG, CKB, CKW, XCKR, XCKG, XCKB, XCKW), which are outputted respectively via eight output terminals of the four buffers of the logic unit, thereby saving the amount of pins of the integrated circuit unit to a certain degree as well as reducing the cost.

Above all, in the demultiplexer of the present invention, the logic unit is added and is configured to transform the three pulse signals, outputted by the integrated circuit unit, having different high and low voltage levels into at least four control signals. In this way, the present invention can avoid outputting each control signal by using each corresponding pin of the integrated circuit unit, thereby reducing the amount of output pins of the integrated circuit unit as well as reducing the cost.

Above all, while the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A demultiplexer (Demux) for a display, comprising:

an integrated circuit unit configured to output three pulse signals including a first pulse signal, a second pulse signal, and a third pulse signal; and a logic unit electrically connected to the integrated circuit unit and configured to transform the three pulse signals having different high and low voltage levels into at least four control signals;

wherein the logic unit comprises four 3-input NAND gates and four buffers, the four buffers and the four 3-input NAND gates are electrically connected to each other in a one-to-one correspondence; the four 3-input NAND gates respectively are a first 3-input NAND gate, a second 3-input NAND gate, a third 3-input NAND gate, and a fourth 3-input NAND gate; the four buffers respectively are a first buffer, a second buffer, a third buffer, and a fourth buffer;

wherein a first input terminal of the first 3-input NAND gate is electrically connected to a second input terminal of the second 3-input NAND gate and the second input terminal of the third 3-input NAND gate; the second input terminal of the first 3-input NAND gate is electrically connected to a third input terminal of the second 3-input NAND gate and the second input terminal of the fourth 3-input NAND gate; the third input terminal of the first 3-input NAND gate is electrically connected to the third input terminal of the third 3-input NAND gate and the third input terminal of the fourth 3-input NAND gate; an output terminal of the first 3-input NAND gate is electrically connected to the first input terminal of the second 3-input NAND gate, the first input terminal of the third 3-input NAND gate, the first input terminal of the fourth 3-input NAND gate, and an input terminal of the first buffer; the output terminal of the second 3-input NAND gate is electrically connected to the input terminal of the second buffer; the output terminal of the third 3-input NAND gate is electrically connected to the input terminal of the third buffer; the output terminal of the fourth 3-input NAND gate is electrically connected to the input terminal of the fourth buffer: the first pulse signal, the second pulse signal, and the third pulse signal are respectively inputted to the first input terminal, the second input terminal, and the third input terminal of the first 3-input NAND gate;

wherein each buffer comprises a first inverter set and the first inverter set comprises three inverters connected in series;

wherein when the first input terminal of the 3-input NAND gate is inputted with an A signal, the second input terminal of the 3-input NAND gate is inputted with a B signal, and the third input terminal of the 3-input NAND gate is inputted with a C signal, then the output terminal of the 3-input NAND gate outputs a D signal, where $D=\overline{A+B+C}$; when the input terminal of the inverter is inputted with an E signal, then the output terminal of the inverter outputs a F signal, where F=E;

wherein the logic unit transforms the three pulse signals having different high and low voltage levels into four control signals; the four control signals respectively are a first control signal, a second control signal, a third control signal, and a fourth control signal.

2. A demultiplexer (Demux) for a display, comprising: an integrated circuit unit configured to output three pulse signals including a first pulse signal, a second pulse signal, and a third pulse signal; and a logic unit electrically connected to the integrated circuit unit and configured to transform the three pulse signals having different high and low voltage levels into at least four control signals, wherein the logic unit comprises NAND gate components and buffer components electrically connected to the N AND gate components: the integrated circuit unit provides three pulse signals to the NAND gate components, wherein the NAND gate components comprise four 3-input NAND gates combined and connected to each other, the buffer components comprises four buffers, and the four buffers and the four 3-input NAND gates are electrically connected to each other in a one-to-one correspondence: the four 3-input NAND gates respectively are a first 3-input NAND gate, a second 3-input NAND gate, a third 3-input NAND gate, and a fourth 3-input NAND gate; the four buffers respectively are a first buffer, a second buffer, a third buffer, and a fourth buffer, wherein a first input terminal of the first 3-input NAND gate is electrically connected to a second input terminal of the second 3-input NAND gate and tire second input terminal of the third 3-inputs NAND gate: the second input terminal of tire first 3-input NAND gate is electrically connected to a third input terminal of the second 3-input NAND gate and the second input terminal of the fourth 3-input NAND gate: the third input terminal of the first 3-input NAND gate is electrically connected to the third input terminal of the third 3-input NAND gate and the third input terminal of the fourth 3-input NAND gate: an output terminal of the first 3-input NAND gate is electrically connected to the first input terminal of the second 3-input NAND gate, the first input, terminal of the third 3-input NAND gate, the first input terminal of the fourth 3-input NAND gate, and an input terminal of the first buffer: the output terminal of the second 3-input NAND gate is electrically connected to the input, terminal of the second buffer: the output terminal of the third 3-input NAND gate is electrically connected to the input terminal of the third buffer; the output terminal of the fourth 3-input NAND gate is electrically connected to the input terminal of the fourth buffet: the first pulse signal, the second pulse signal, and the third pulse signal are respectively inputted to the first input terminal, the second input terminal, and the third input terminal of the first 3-input NAND gate, wherein each buffer comprises a first inverter set and the first inverter set, comprises three inverters connected in series, and wherein each buffer further comprises a second inverter set, the second inverter set comprises two inverters connected in series, and the second inverter set and the first inverter set are connected in parallel.

3. The demultiplexer for the display according to claim 2, wherein when the first input terminal of the 3-input NAND gate is inputted with an A signal, the second input terminal of the 3-input NAND gate is inputted with a B signal, and the third input terminal of the 3-input NAND gate is inputted with a C signal, then the output terminal of the 3-input NAND gate outputs a D signal, where $D=\overline{A+B+C}$; when the input terminal of the inverter is inputted with an E signal, then the output terminal of the inverter outputs a F signal, where $F=\overline{E}$.

4. The demultiplexer for the display according to claim 2, wherein the logic unit transforms the three pulse signals having different high and low voltage levels into four control signals: the four control signals respectively are a first control signal, a second control signal, a third control signal, and a fourth control signal.

5. The demultiplexer for the display according to claim 2, wherein the logic unit transforms the three pulse signals having different high and low voltage levels into eight control signals; the eight control signals respectively are a first control signal, a second control signal, a third control signal, a fourth control signal, a fifth control signal, a sixth control signal, a seventh control signal, and an eighth control signal.

6. A liquid crystal display, comprising a demultiplexer (Demux);

the demultiplexer comprising an integrated circuit unit and a logic unit electrically connected to the integrated circuit unit;

the integrated circuit unit configured to output three pulse signals including a first pulse signal, a second pulse signal, and a third pulse signal; and the logic unit configured to transform the three pulse signals having different high and low voltage levels into at least four control signals, wherein the logic unit comprises NAND gate components and buffer components electrically connected to the N AND gate components; the integrated circuit unit provides three pulse signals to the NAND gate components, wherein the NAND gate components comprise four 3-input NAND gates combined and connected to each other, the buffer components comprises four buffers, and the tour buffers and the four 3-input NAND cates are electrically connected to each other in a one-to-one correspondence: the four 3-input NAND gates respectively are a first 3-input NAND gate, a second 3-input NAND gate, a third 3-input NAND gate, and a fourth 3-input NAND gate; the four buffers respectively are a first buffer, a second buffer, a third buffer, and a fourth buffer, wherein a first input terminal of the first 3-input NAND gate is electrically connected to a second input terminal of the second 3-input NAND gale and the second input terminal of the third 3-inputs NAND gate: the second input terminal of the first 3-input NAND gate is electrically connected to a third input terminal of the second 3-input NAND gate and the second input terminal of the fourth 3-input NAND gate: the third input terminal of the first 3-input NAND gate is electrically connected to the third input terminal of the third 3-input NAND gate and the third input terminal of the fourth 3-input NAND gate; an output terminal of the first 3-input NAND gate is electrically connected to die first input terminal of the second 3-input NAND gate, the first input terminal of the third 3-input NAND gate, the first input terminal of the fourth 3-input NAND gate, and an input terminal of the first buffer: the output terminal of the second 3-input NAND gate is electrically connected to the input terminal of the second buffer: the output terminal of the third 3-input NAND gate is electrically connected to the input terminal of the third buffer: the output terminal of the fourth 3-input NAND sate is electrically connected to the input terminal of the fourth buffer: the first pulse signal, the second pulse signal, and the third pulse signal are respectively inputted to the first input terminal, the second input terminal, and the third input terminal of the first 3-input NAND gate, wherein each buffer comprises a first inverter set and the first inverter set comprises three inverters connected in series, and wherein each buffer further comprises a second inverter set, the second inverter set comprises two inverters connected in series, and the second inverter set and the first inverter set are connected in parallel.

7. The liquid crystal display according to claim 6, wherein when the first input terminal of the 3-input NAND gate is inputted with an A signal, the second input terminal of the 3-input NAND gate is inputted with a B signal, and the third input terminal of the 3-input NAND gate is inputted with a C signal, then the output terminal of the 3-input NAND gate outputs a D signal, where $D=\overline{A+B+C}$; when the input terminal of the inverter is inputted with an E signal, then the output terminal of the inverter outputs a F signal, where $F=\overline{E}$.

8. The liquid crystal display according to claim 6, wherein the logic unit transforms the three pulse signals having different high and low voltage levels into four control signals; the four control signals respectively are a first control signal, a second control signal, a third control signal, and a fourth control signal.

9. The liquid crystal display according to claim 6, wherein the logic unit transforms the three pulse signals having different high and low voltage levels into eight control signals; the eight control signals respectively are a first control signal, a second control signal, a third control signal, a fourth control signal, a fifth control signal, a sixth control signal, a seventh control signal, and an eighth control signal.

* * * * *